US012501946B2

(12) United States Patent
Blaisdell et al.

(10) Patent No.: US 12,501,946 B2
(45) Date of Patent: Dec. 23, 2025

(54) SOCK

(71) Applicant: Laetts Innovations, LLC, Bountiful, UT (US)

(72) Inventors: Mark H. Blaisdell, Bountiful, UT (US); Jing Lu Huang, Toronto (CA)

(73) Assignee: Laetts Innovations, LLC, Bountiful, UT (US)

( * ) Notice: Subject to any disclaimer, the term of this patent is extended or adjusted under 35 U.S.C. 154(b) by 0 days.

(21) Appl. No.: 18/416,218

(22) Filed: Jan. 18, 2024

(65) Prior Publication Data

US 2024/0156178 A1 May 16, 2024

Related U.S. Application Data

(63) Continuation-in-part of application No. 17/825,462, filed on May 26, 2022, now abandoned.

(60) Provisional application No. 63/593,463, filed on Oct. 26, 2023, provisional application No. 63/194,385, filed on May 28, 2021.

(51) Int. Cl.
*A41B 11/02* (2006.01)

(52) U.S. Cl.
CPC ..... *A41B 11/02* (2013.01)

(58) Field of Classification Search
USPC ..... 2/239, 240, 241
See application file for complete search history.

(56) References Cited

U.S. PATENT DOCUMENTS 4,561,267 A 12/1985 Wilkinson et al.
5,737,943 A 4/1998 Bernhardt
6,708,348 B1 3/2004 Romay
2006/0085894 A1 4/2006 Yakopson et al.
2006/0218701 A1 10/2006 Liberman
2008/0301860 A1 12/2008 Iqbal
2009/0158504 A1 6/2009 Sparrow et al.
(Continued)

FOREIGN PATENT DOCUMENTS

DE 20307702 U1 * 8/2003 ..... A41B 11/02
NL 2014372 10/2016
NL 2014372 B1 * 10/2016 ..... A41B 11/02

OTHER PUBLICATIONS

Machine Translation of DE-20307702-U1, provided by Espacenet Patent Translate, generated on Oct. 16, 2023 (Year: 2023).*
(Continued)

*Primary Examiner* — Jocelyn Bravo
(74) *Attorney, Agent, or Firm* — Workman Nydegger

(57) ABSTRACT

A sock includes a sock body with portions formed from different materials to provide decreased friction in particular regions of the sock. A decreased friction portion (a) is provided to include both a heel portion and a portion directly above the heel portion of the sock, and/or a decreased friction portion (b) is provided on a front portion of the sock, corresponding to a location of a tongue of a boot or shoe when the sock is worn over a user's foot, inserted into such boot or shoe. Portions (a) and (b) can be formed from one or more of a low friction nylon or low friction polyester material having a lower coefficient of friction than a remainder of the sock body, which remainder of the sock body can be formed from wool, cotton, a cotton blend, etc., which material has greater friction, providing other desired properties (e.g., insulation, wicking).

20 Claims, 13 Drawing Sheets

(56) References Cited

U.S. PATENT DOCUMENTS

| | | | | |
|---|---|---|---|---|
| 2011/0131706 | A1 | 6/2011 | Andersson | |
| 2011/0239352 | A1 | 10/2011 | Ramsey et al. | |
| 2012/0023641 | A1 | 2/2012 | Shen et al. | |
| 2014/0053320 | A1 | 2/2014 | Hasan et al. | |
| 2018/0146718 | A1* | 5/2018 | Parnell | A61F 7/034 |
| 2020/0268068 | A1* | 8/2020 | Okada | A41D 13/08 |

OTHER PUBLICATIONS

Non-Final Office Action received for U.S. Appl. No. 17/825,462, mailed on Oct. 19, 2023, 12 pages.

* cited by examiner

SOCK

CROSS-REFERENCE TO RELATED APPLICATIONS

The present application is a continuation-in-part of U.S. application Ser. No. 17/825,462, filed May 26, 2022 and entitled SOCK, which claims the benefit of U.S. Application No. 63/194,385, filed May 28, 2021 entitled SOCK. The present application also claims the benefit of U.S. Application No. 63/593,463, filed Oct. 26, 2023 entitled SOCK, each of which is herein incorporated by reference in its entirety.

BACKGROUND OF THE INVENTION

1. The Field of the Invention

This invention relates to socks.

2. Background and Relevant Art

Boots, such as ski boots and the like can sometimes be difficult to put on. It would be an advantage in the art to provide a sock that could be used to make putting on such boots easier.

BRIEF SUMMARY

The present invention is directed to socks that include specific portions thereof that include or are formed from a material exhibiting increased slickness (i.e., decreased friction) to aid in putting a socked foot into a ski boot or similar boot that may otherwise be difficult to put on.

The sock may otherwise be formed of typical fabric materials (e.g., cotton, wool, cotton-polyester blend, etc.). Specific portions of the sock are formed from a different material, that provides for decreased friction (i.e., allowing a socked foot to be more easily pulled or pushed into a ski boot or other boot). In particular, a region just above the heel of the sock may be formed from such low friction fabric or other material. Alternatively or in addition, an opposite surface on the front face of the sock (e.g., corresponding to the location of the tongue of a shoe or boot) is also formed from such a low friction fabric or other material. By way of example, this portion or portions of the sock may be formed from a low friction 100% polyester or nylon material. Other slick, low friction materials will be apparent to those of skill in the art, and may also be suitable for use. The portion or patch of material having low friction may exhibit a lower coefficient of friction than the other portions of the sock.

Both the rear low friction portion above the heel and the front low friction portion corresponding to the tongue location may have a width of e.g., from 1-3 inches (e.g., about 2 inches). Such portions may have a length that is greater than the width (e.g., so as to be elongate). For example, the length of such locations may be from 2-5 inches, or from 3-4 inches. In an embodiment, the low friction portion above the heel may have a length of about 4 inches, and the front low friction portion may have a length of about 3 inches.

In an embodiment, the sock is not simply formed entirely from such a low friction material, as such materials may not provide other desired characteristics (e.g., ability to wick away moisture, breathability, insulation, etc.). Thus, in an embodiment, only limited portions of the sock (e.g., the two portions noted herein) are formed from the low friction material. The remainder of the sock body (i.e., consisting of the sock body, other than the two decreased friction patch portions) may be formed from more conventional sock materials, such as wool, a cotton blend, etc.

Attachment of the low friction portion(s) of the sock to the underlying or other sock portions may be by any suitable means, such as stitching, or use of an adhesive (e.g., hot iron adhesive), combinations thereof, or other attachment mechanisms that will be apparent to those of skill in the art. In an embodiment, such portions may simply be woven into the adjacent portions of the sock body.

In an embodiment, the low friction portions of the sock are woven into a wool or other material of the sock body, with exposure on both an inside and outside of the sock, so as to contact a user's foot inserted into the sock during use.

In an embodiment, the sock further includes hygroscopic threads or other hygroscopic material, which provides a heating effect when such threads or other material is moistened or damp. In an embodiment, the hygroscopic threads or other hygroscopic material is woven into a material of the sock body, such hygroscopic threads or other hygroscopic material being positioned along a bottom portion of the foot of the sock, to warm a bottom portion of a user's feet during use. In an embodiment, the hygroscopic threads or other hygroscopic material is woven into a material of the sock body, such hygroscopic threads or other hygroscopic material being positioned along an upper rear portion of the sock, to warm a rear portion of a user's legs covered by the sock during use.

The socks may be provided with distinct left and right socks, which are not identical or interchangeable with one another. For example, a pair of socks may include a left sock including a left sock body including portions formed from different materials to provide decreased friction in particular regions of the left sock. A decreased friction portion (a) of the left sock body is provided directly above a heel portion of the left sock. A decreased friction portion (b) of the left sock body is provided on a front portion of the left sock, corresponding to a location of a tongue of a boot or shoe when the left sock is worn over a user's left foot, inserted into such boot or shoe. A right sock includes a right sock body including portions formed from different materials to provide decreased friction in particular regions of the right sock, where a decreased friction portion (a) of the right sock body is provided directly above a heel portion of the right sock. A decreased friction portion (b) of the right sock body is provided on a front portion of the right sock, corresponding to a location of a tongue of a boot or shoe when the right sock is worn over a user's right foot, inserted into such boot or shoe. The left and right socks are not identical to one another, but differ in how portion (a) and portion (b) of the left and right socks are positioned or oriented, relative to a fold line of the left and right socks. For example, on both the left and right socks, a greater surface area of the heel portion (a) is positioned or oriented towards an interior of the leg, with a lesser surface area of heel portion (a) positioned or oriented towards an exterior of the leg. On both the left and right socks, a greater surface area of the tongue portion (b) is positioned or oriented towards an exterior of the leg, with a lesser surface area of tongue portion (b) positioned or oriented towards an interior of the leg.

In an embodiment, the decreased friction patch portions do not comprise Teflon, or a similar fluorocarbon or perfluorocarbon polymer or other material that includes fluorine.

In an embodiment, the decreased friction patch portions do not comprise Teflon, nylon, or satin (e.g., formed from silk), as used in NL2014372 (herein incorporated by reference in its entirety). For example, by avoiding such materials (Teflon in particular) no particular modifications need to be made to knitting needles, which may be required with materials such as Teflon, which can be difficult, if not impossible as a practical matter to use in stitching, weaving or the like. For example, NL2014372 describes how when using Teflon, it may not be possible to sew or stitch such a material, which may instead have to be heat sealed, or glued. Such materials may be absent from the presently described embodiments (e.g., no adhesives required).

In the presently described embodiments, the material of the decreased friction patch may consist or consist essentially of the decreased friction material (e.g., no wool or high friction material present, in contrast to the configuration shown in FIG. 6 of NL2014372).

In an embodiment, no friction reduction patch is present at the user's ankle, in contrast to as described in NL2014372.

In an embodiment, no friction reduction patch is present at the user's instep (bony structure on top of the foot), in contrast to as described in NL2014372.

In an embodiment, no friction reduction patch is present at the user's sole, in contrast to as described in NL2014372.

In an embodiment, no friction reduction patch is present at the user's side of the foot, in contrast to as described in NL2014372.

In an embodiment, the decreased friction patches consist of the described heel patch and the tongue patch (no patches such as those described in NL2014372 are present).

In an embodiment, the friction reduction patch(es) are not elastic, in contrast to as described in NL2014372.

In an embodiment, the friction reduction patch(es) are not provided or used in conjunction with a two-part boot that includes an inner boot and an outer boot, in contrast to as described in NL2014372. Rather, the patches are provided on a simple sock, as shown and described, which is inserted into a simple single part boot (e.g., a ski boot).

While NL2014372 may describe incorporation of some low friction portions within a sock, importantly, it does not teach or suggest inclusion of the configuration described herein, particularly inclusion of a decreased friction patch (b) on a front portion of the sock, corresponding to a location of a tongue of a boot or shoe when the sock is worn over a user's foot, inserted into such boot or shoe. Testing by Applicant has shown that particularly the installation of a ski boot is far easier, when this is provided, as compared to when it is not present. Test result videos showing such results are available from Applicant, which are evidence of surprising results associated with the presently described socks.

In an embodiment, no areas of padding are provided, in contrast to as described in DE20307702U1.

Any specific features shown in NL2014372, DE20307702U1 (each herein incorporated by reference in its entirety), or any other references noted on the PTO-892 "Notice of References Cited" attached to the Office Action dated Oct. 19, 2023 in the parent application may be absent from the presently described sock, which includes its own specific configuration, with differences that may initially appear superficial, but which are important to providing an improved user experience. Each reference on the above noted PTO-892 is herein incorporated by reference in its entirety, which references include US20060085894, US20080301860, US20060218701, U.S. Pat. No. 5,737,943; US20140053320, US20110131706, U.S. Pat. Nos. 4,561,267; 6,708,348; US20110239352, US20090158504, and US20120023641, each of which is herein incorporated by reference in its entirety.

An exemplary sock may be formed from wool (e.g., greater than 50% or greater than 60% by weight, such as 60-70%), nylon (e.g., 10-20% or 10-15%), acrylic (e.g., 5-15%, or 10-15%), viscose (e.g., 5-15%, or 10-15%), spandex (e.g., less than 5%, or less than 3%, such as 1-3%, and polyester (e.g., less than 5%, or less than 3%, such as 1-3%).

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The appended drawings contain figures of example embodiments to further illustrate and clarify the above and other aspects, advantages and features of the present invention. It will be appreciated that these drawings depict only example embodiments of the invention and are not intended to limit its scope. The invention will be described and explained with additional specificity and detail through the use of the accompanying drawings.

DETAILED DESCRIPTION

Figure 1:
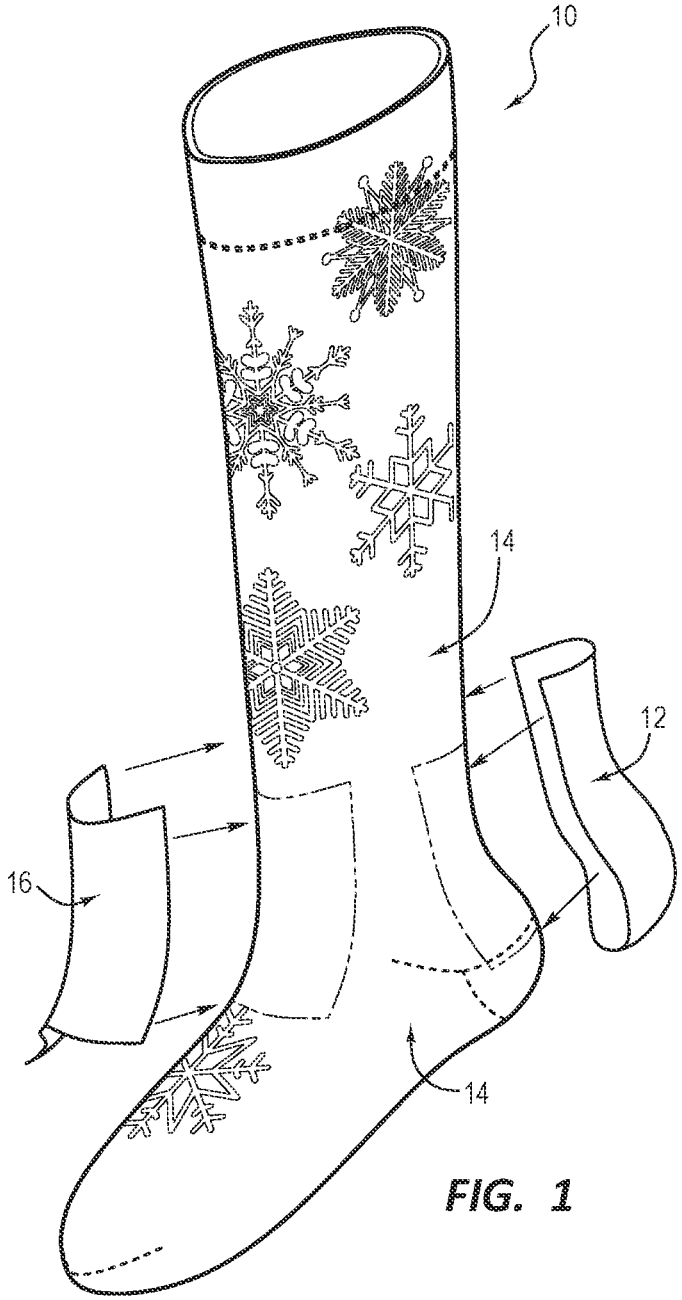
FIGS. 1-3 show an exemplary sock according to the present invention.
Figure 2:
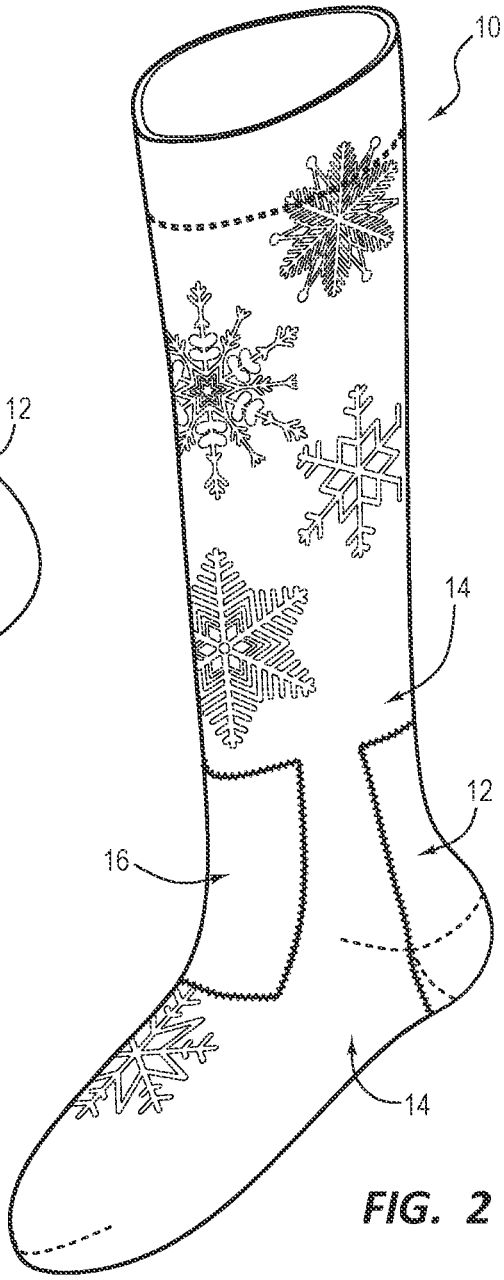
Figure 3:
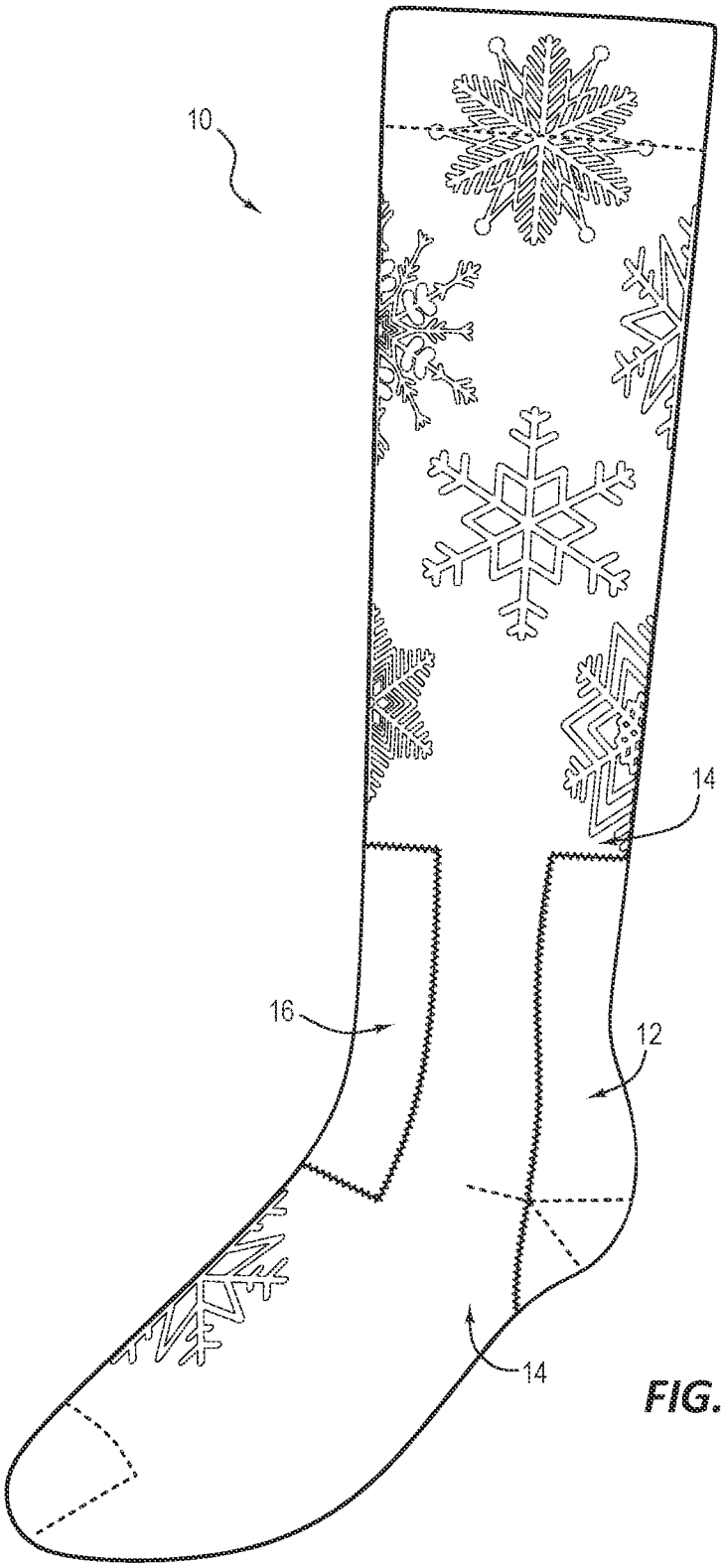
Figure 4:
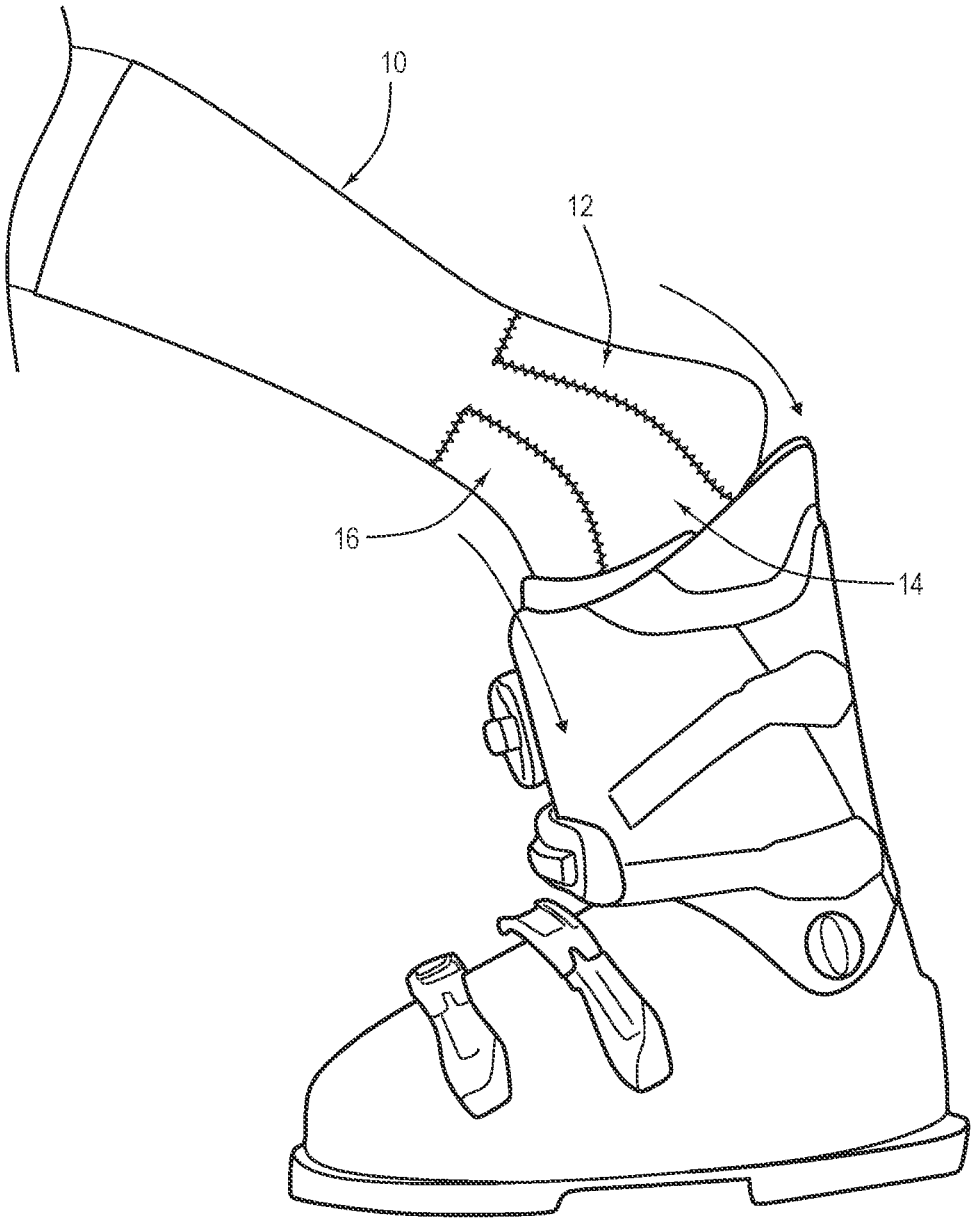
FIGS. 4-5 show the socked foot of a user being inserted into a ski boot, aided by the low friction portions of the sock, as described herein.
Figure 5:
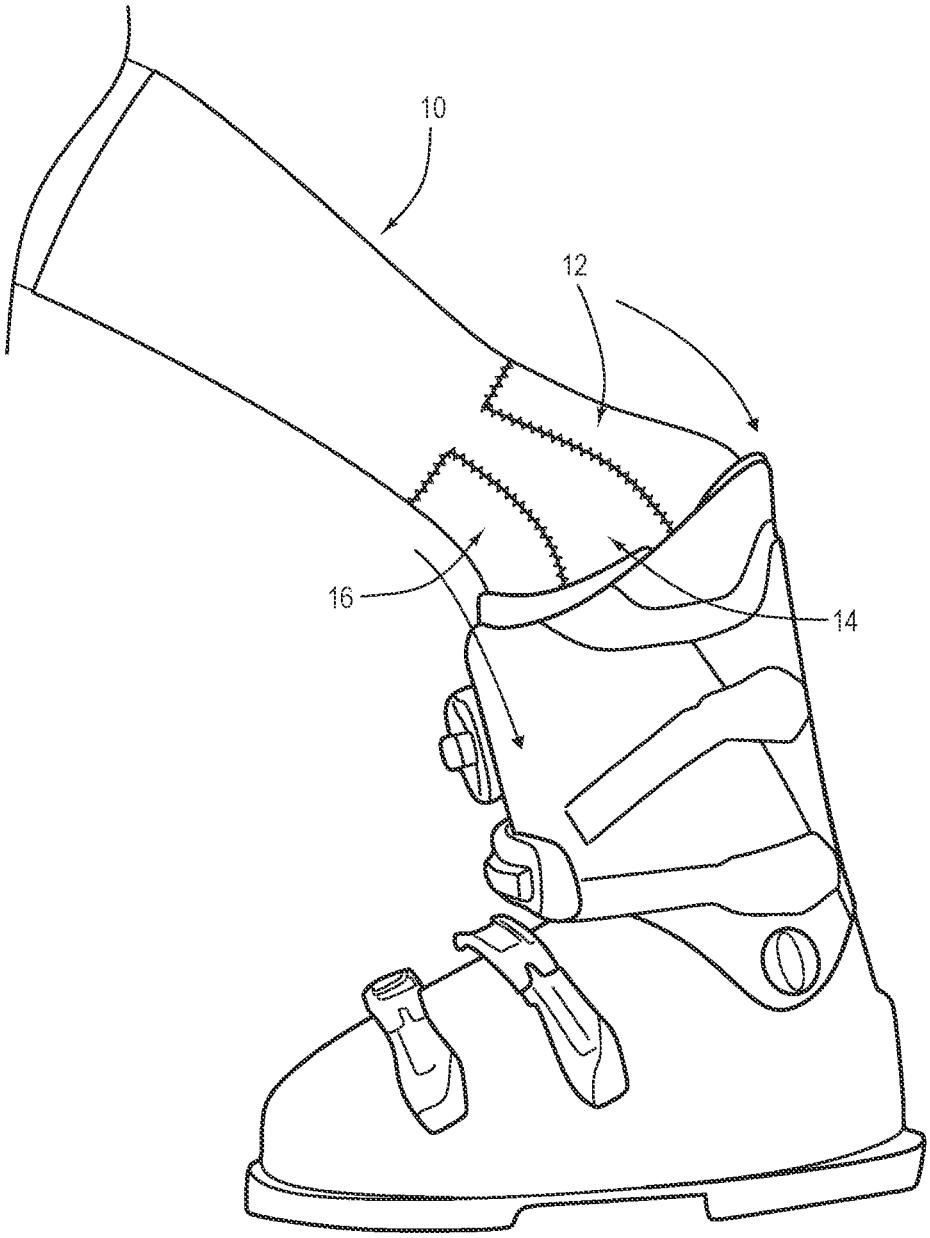
Figure 6:
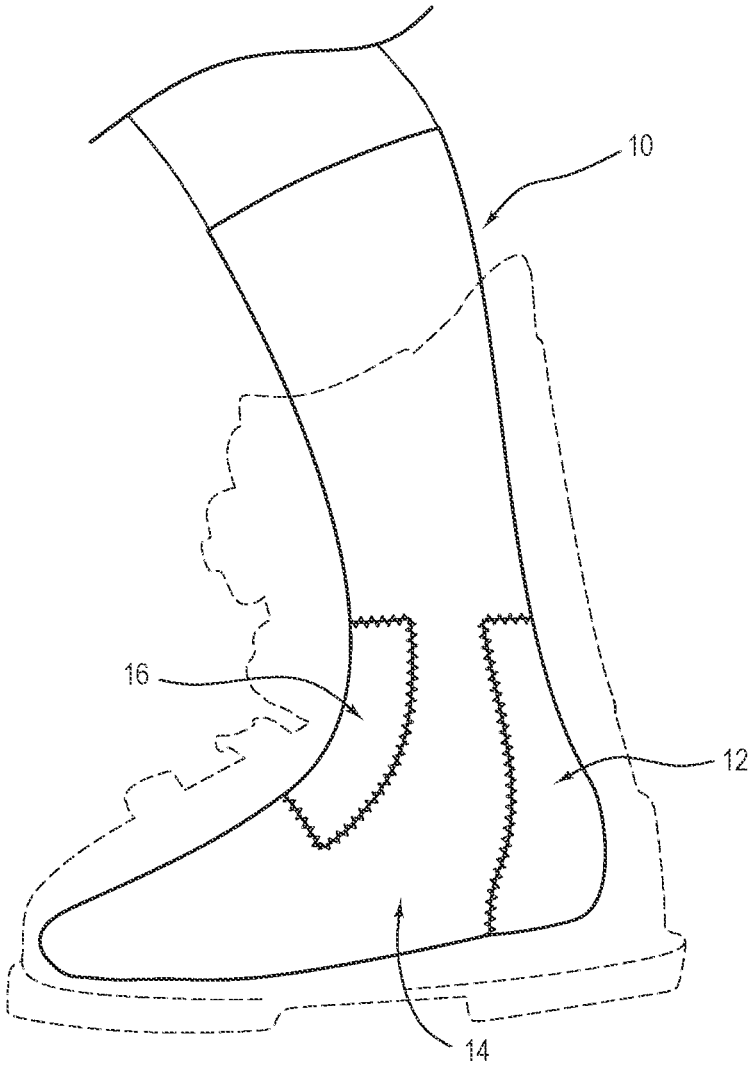
FIG. 6 shows the socked foot of the user, fully inserted into the ski boot of FIGS. 4-5.
Figure 7:
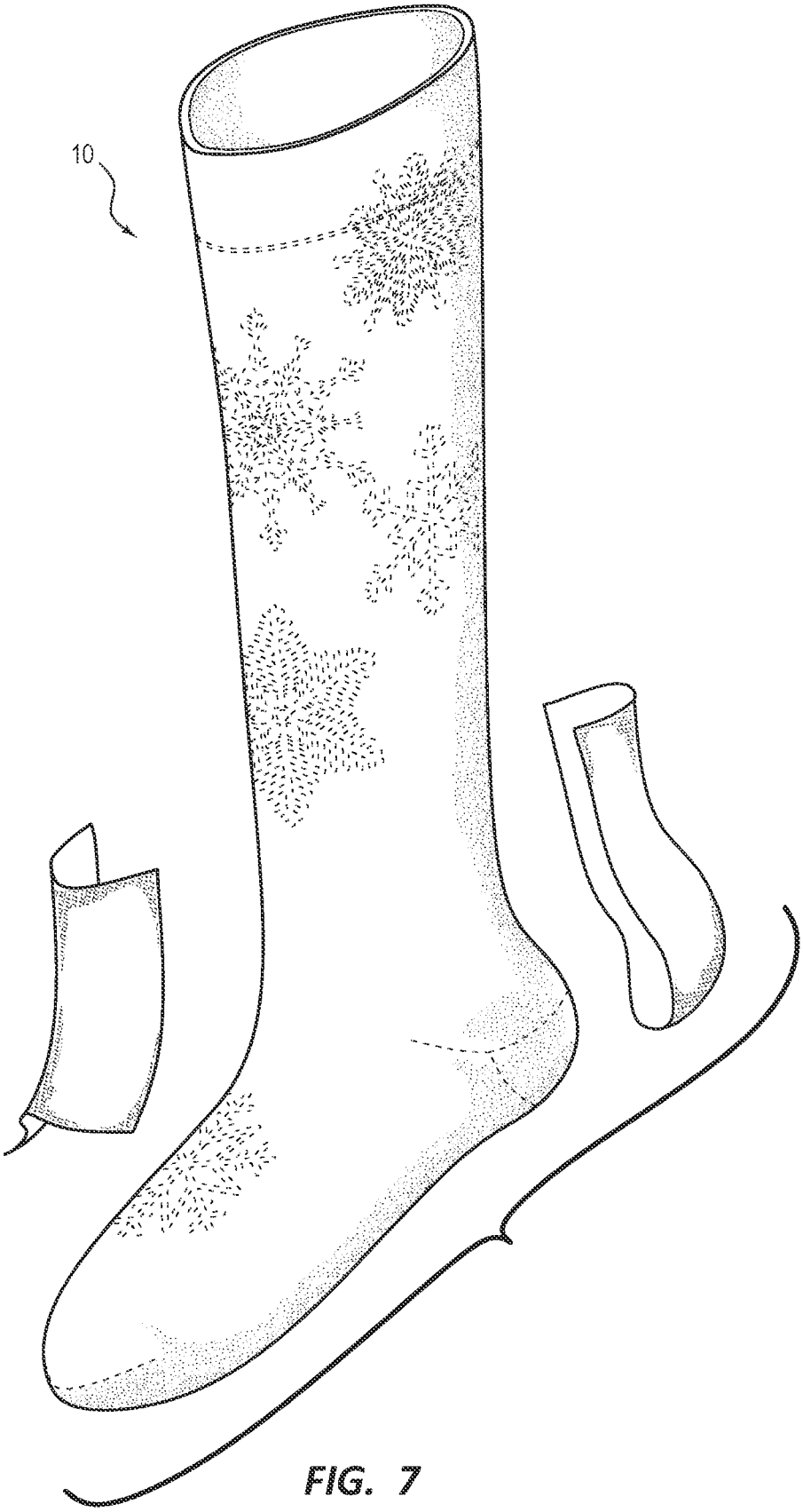
FIGS. 7-12 show additional isometric views of an exemplary sock according to the present invention.
Figure 8:
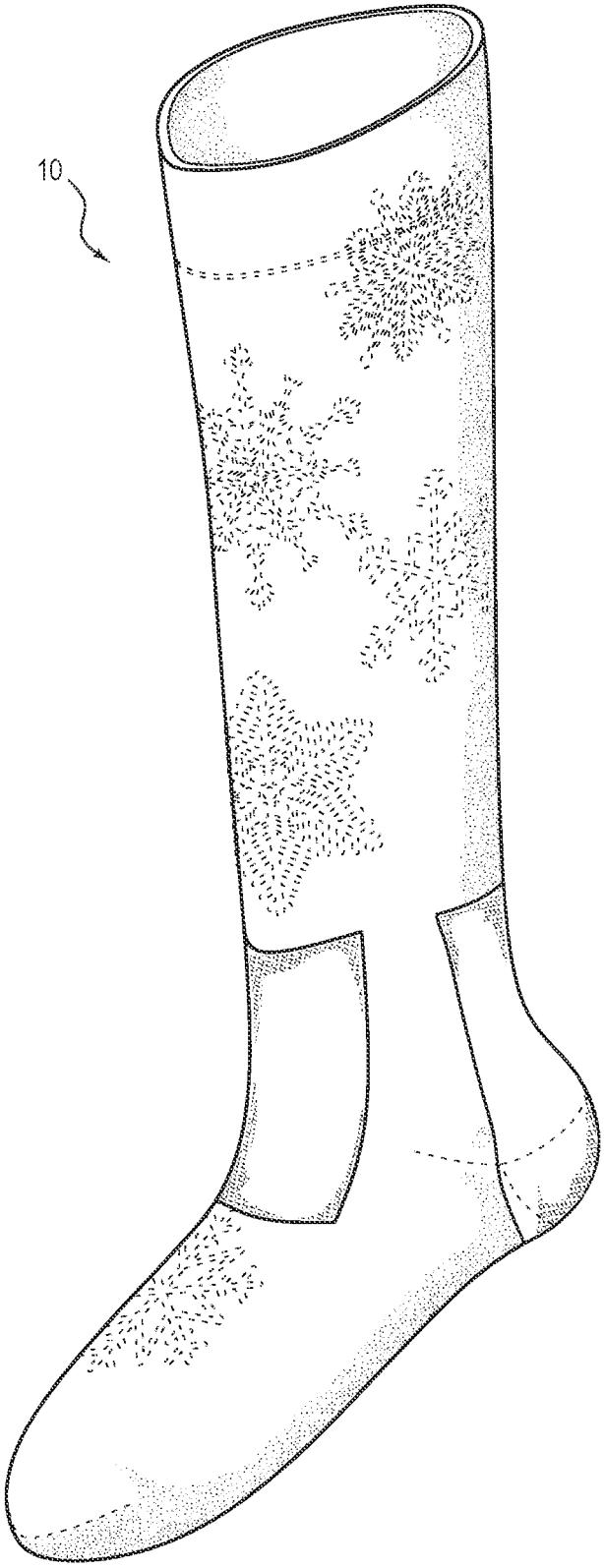
Figure 9:
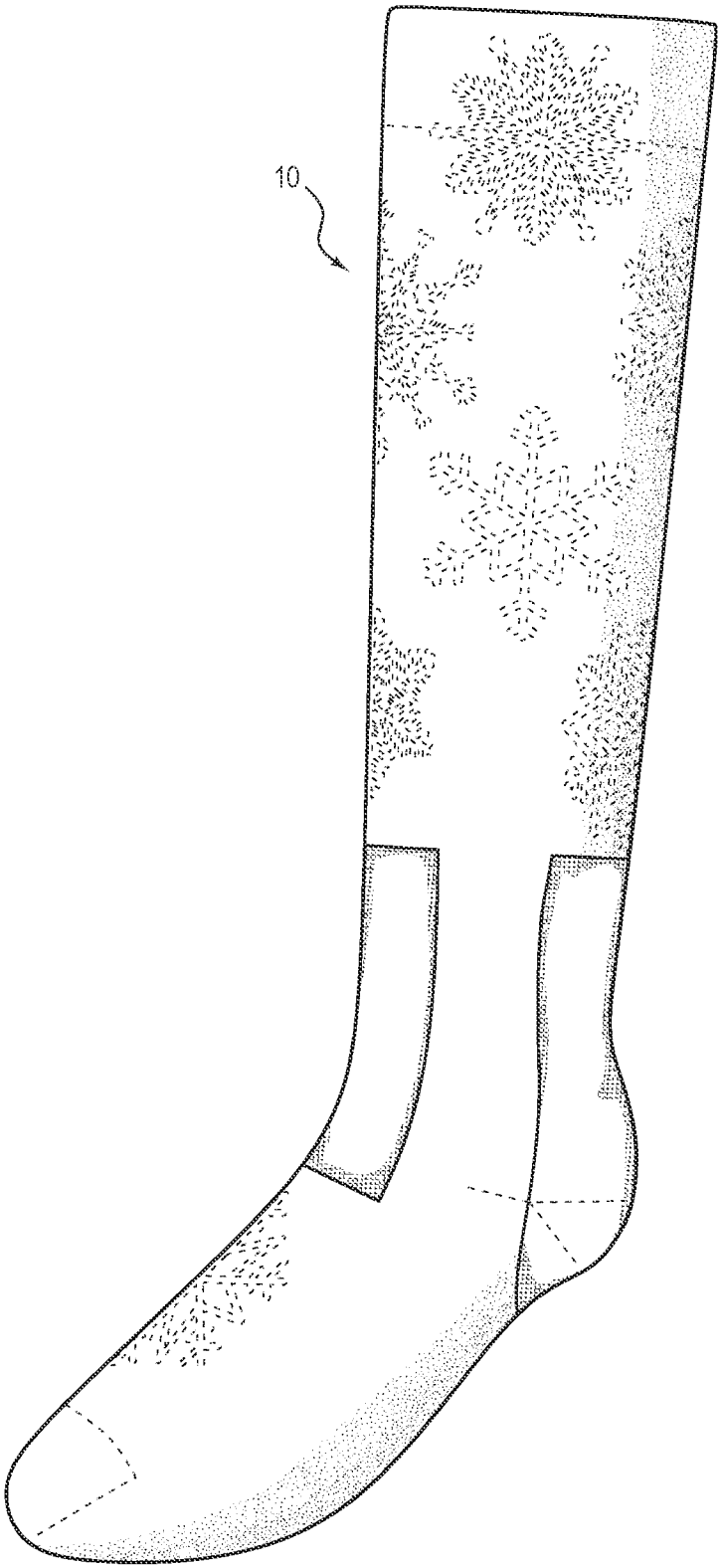
Figure 10:
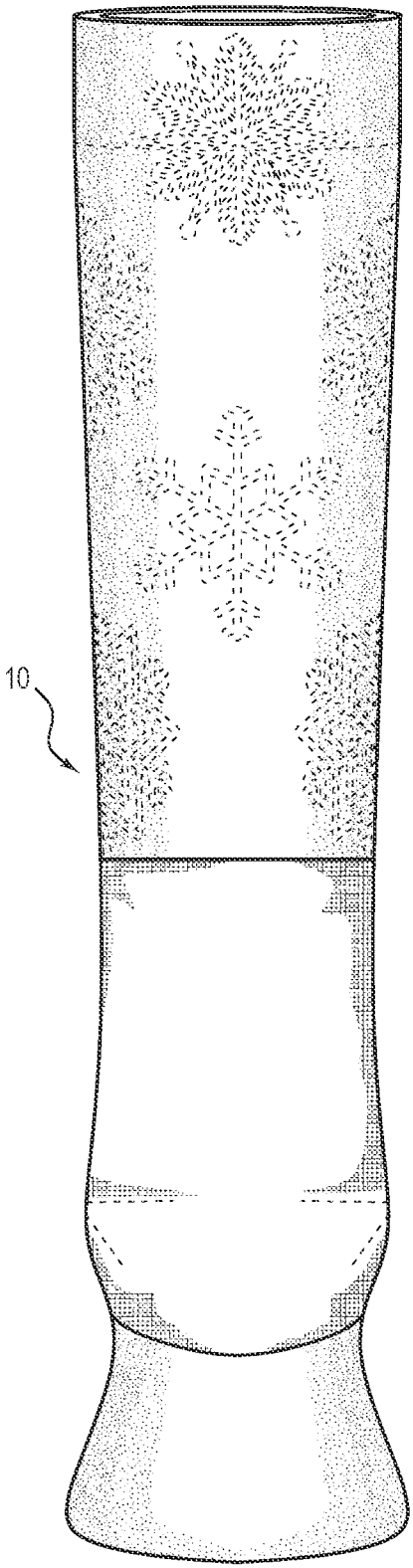
Figure 12:
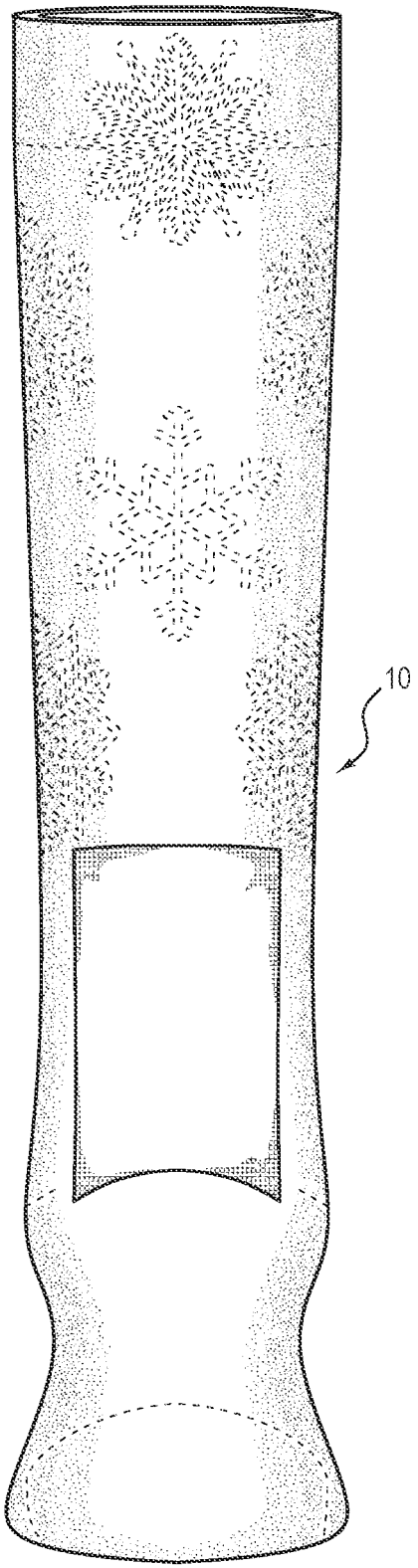
Figure 11:
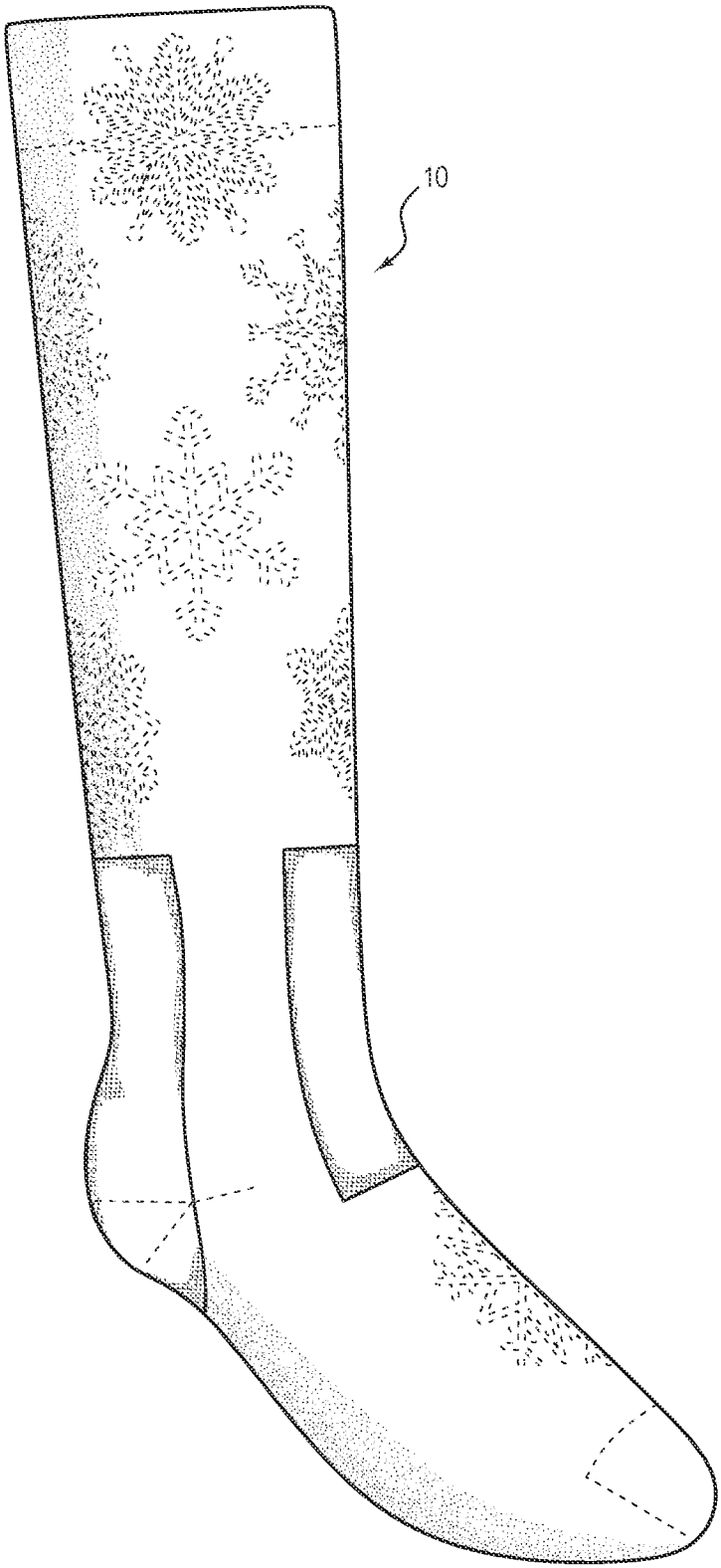
Figure 13:
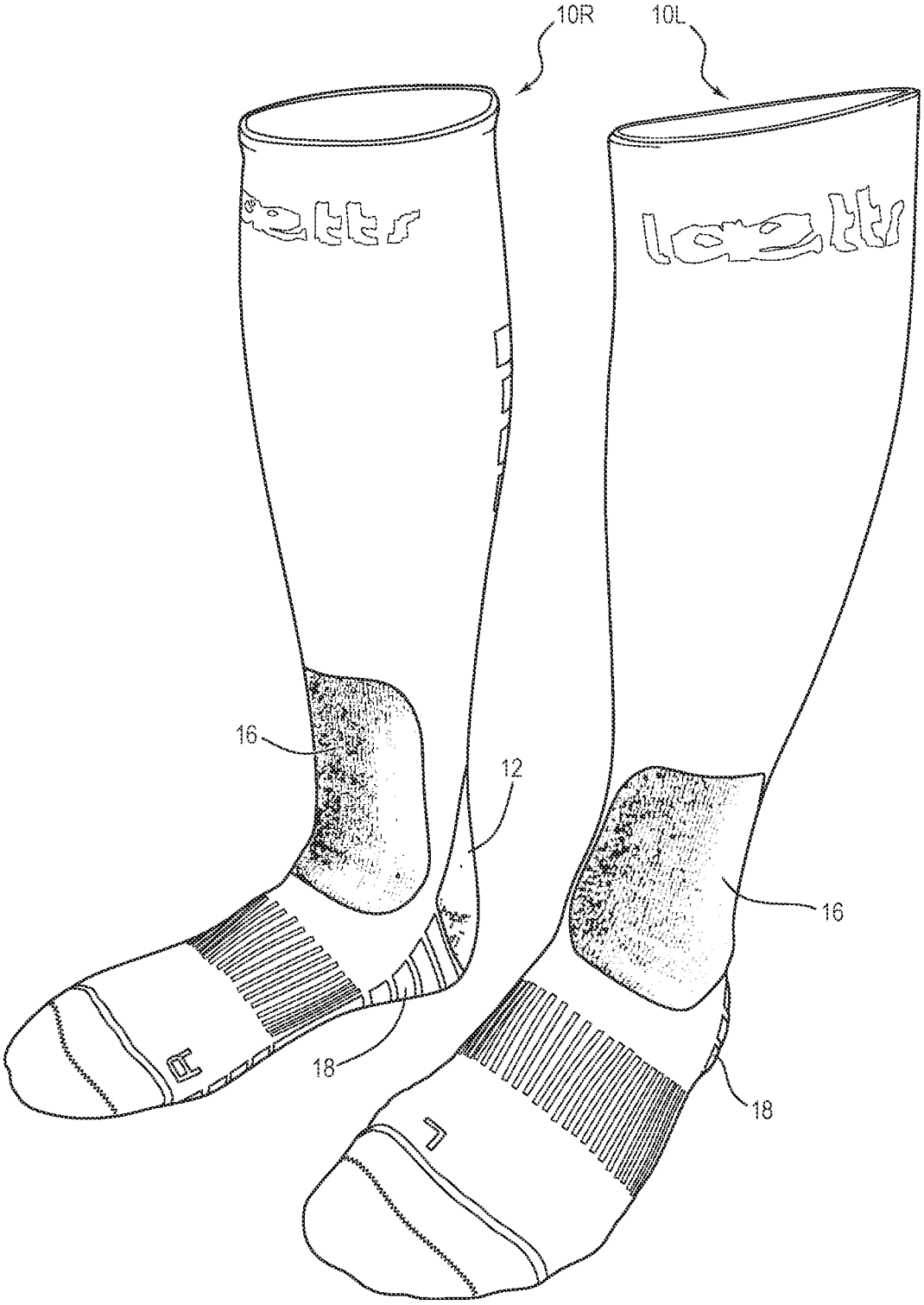
FIGS. 13-16B show additional views of a pair of exemplary socks according to the present invention.
Figure 14:
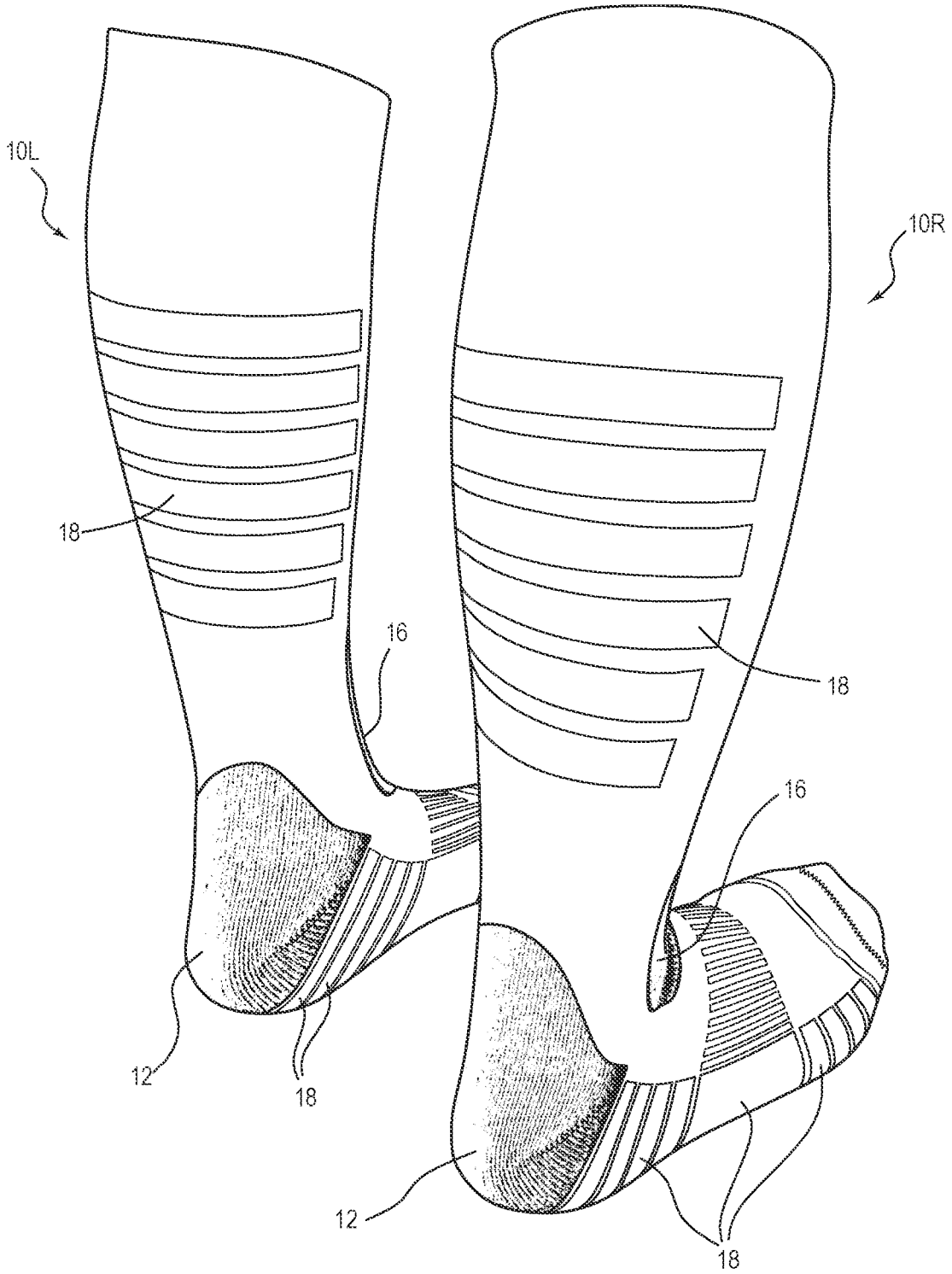
Figure 15A:
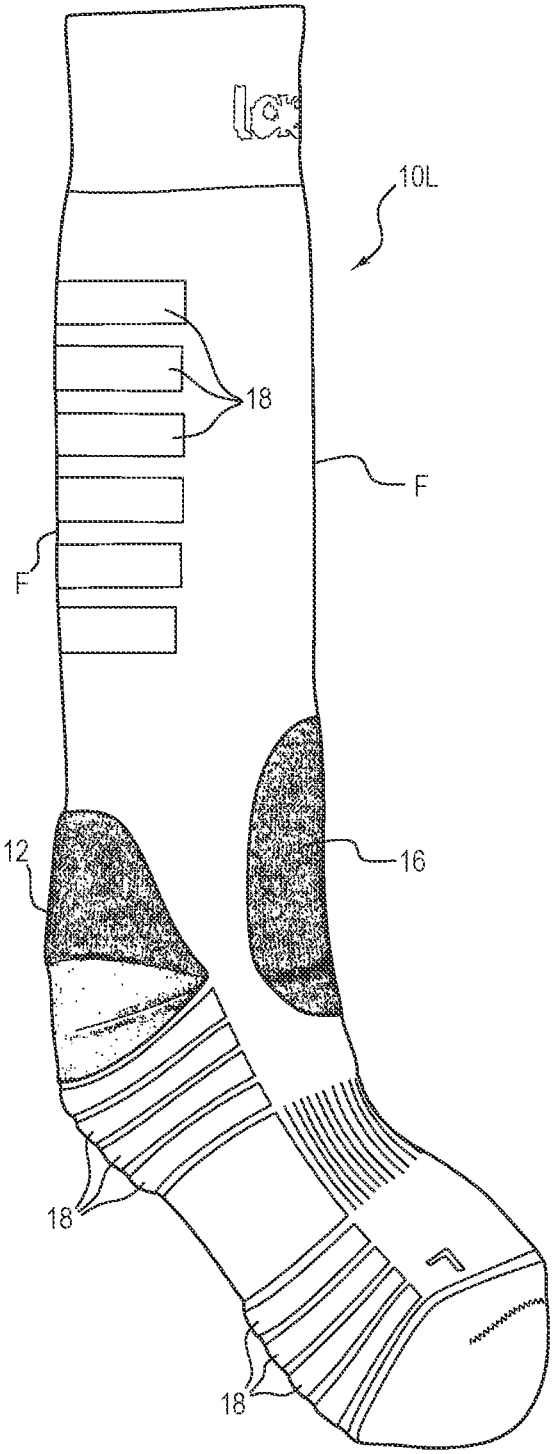
Figure 15B:
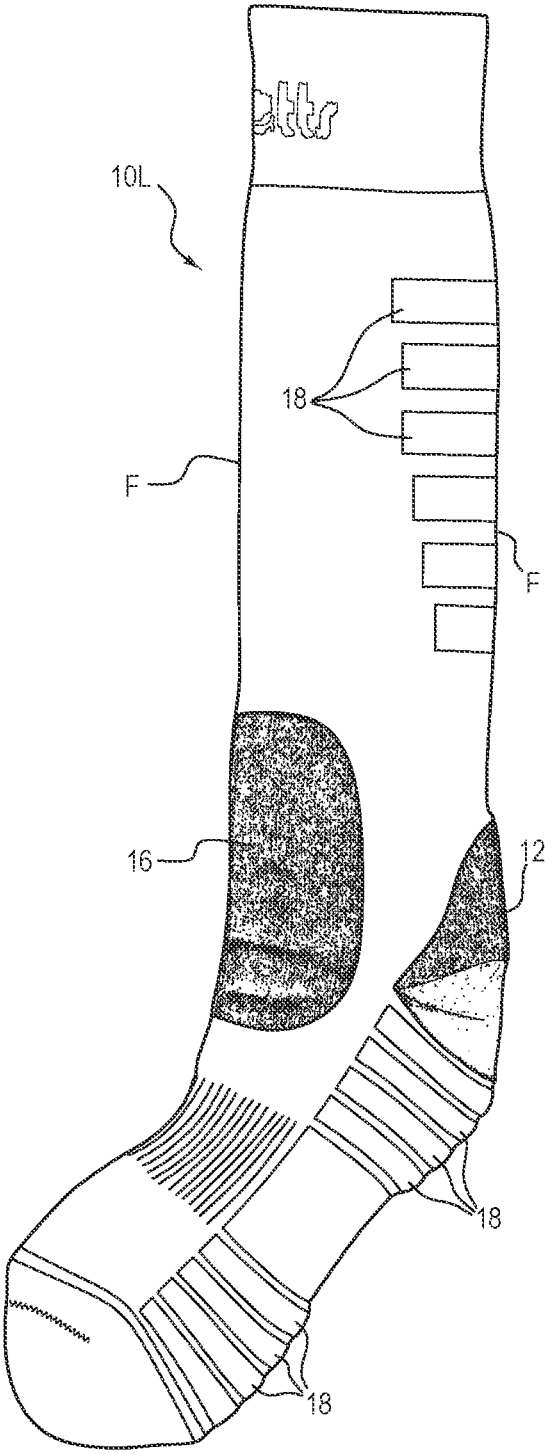
Figure 16A:
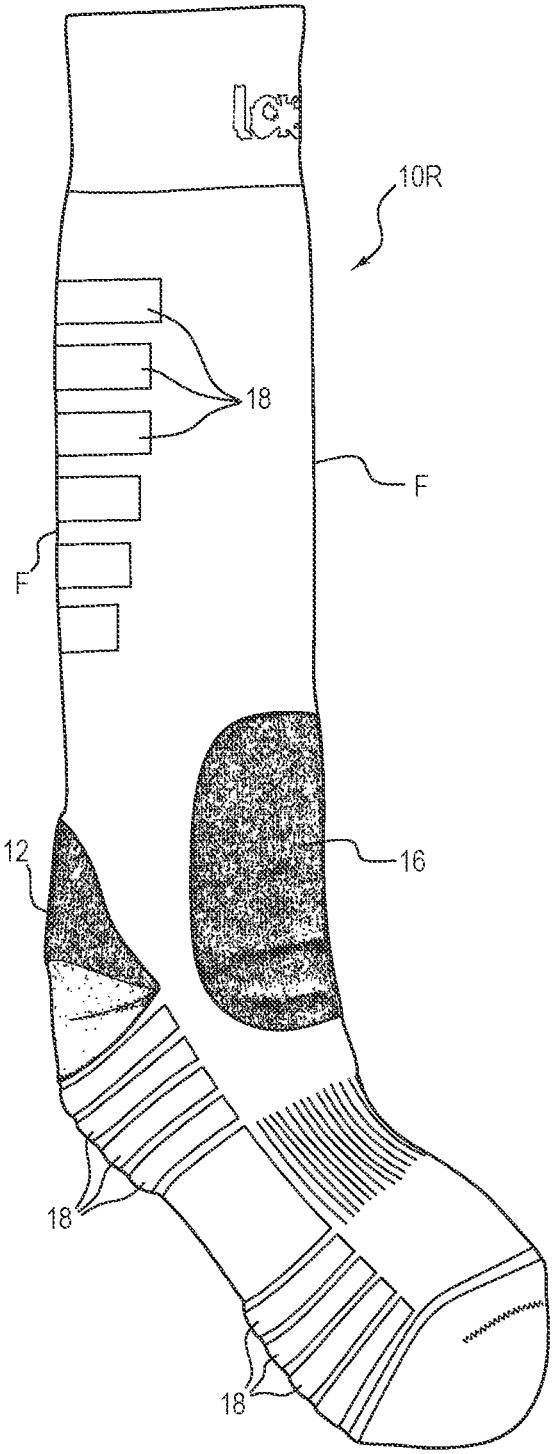
Figure 16B:
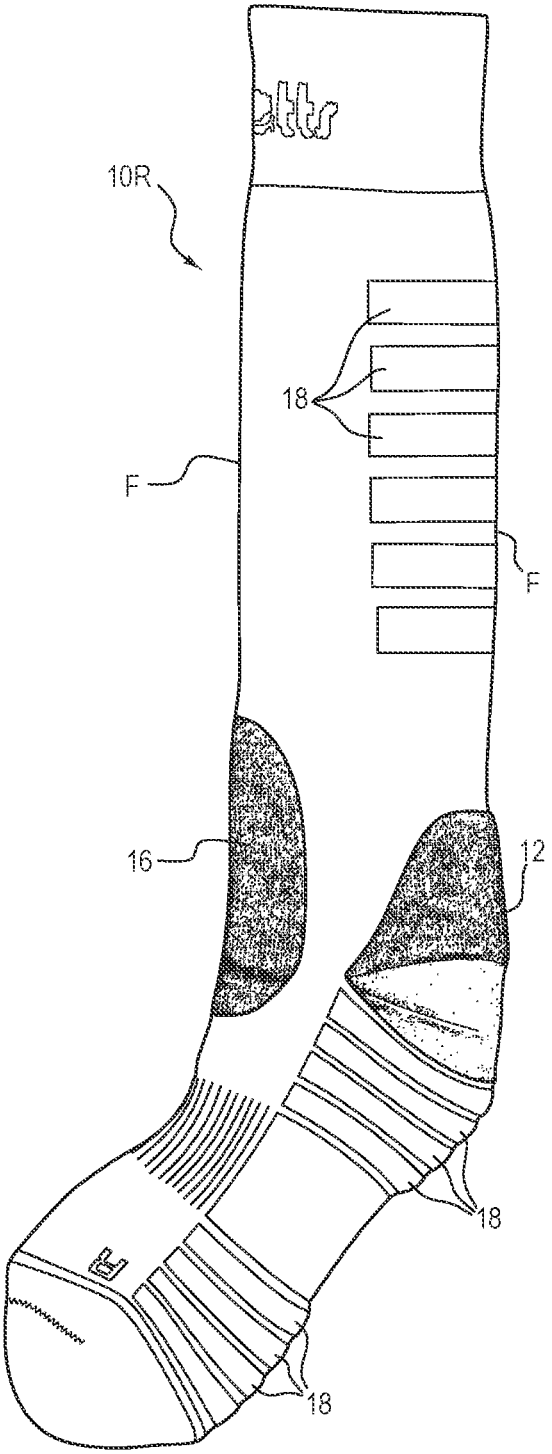

The present invention is directed to socks that include specific portions thereof that include or are formed from a material exhibiting increased slickness (i.e., decreased friction, lower coefficient of friction) to aid in putting a socked foot into a ski boot or similar boot that may otherwise be difficult to put on.

The sock 10 may otherwise be formed of typical fabric materials (e.g., cotton, wool, cotton-polyester blend, etc.). Specific portions of the sock are formed from a different material, that provides for decreased friction (i.e., allowing a socked foot to be more easily pulled or pushed into a ski boot or other boot). In particular, referring to the Figures (e.g., FIGS. 1-12) the region including the heel and just above the heel of the sock (labeled heel patch 12) may be formed from such a low friction fabric or other low friction material. For example, patch 12 may be formed from a fabric material having a lower coefficient of friction than the coefficient of friction for the surrounding portions 14, of sock 10. By forming the heel and adjacent portions of the sock (e.g., heel and above the heel) from such a lower friction fabric material, a user will find it far easier to insert their socked foot into a boot (e.g., a ski boot), high top shoe, or the like.

Alternatively or in addition, an opposite surface on the front face of the sock (e.g., corresponding to the location of the tongue of a shoe or boot, which portion is labeled 16) is also formed from such a low friction fabric material. By way of example, portions 12, 16 of the sock 10 may be formed from a low friction polyester or low friction nylon material.

In an embodiment, such patches 12, 16 may be 100% low friction polyester, 100% low friction nylon, or a blend of low friction polyester and low friction nylon. Based on the present disclosure, other slick, low friction materials that may be suitable for use will be apparent to those of skill in the art, and may also be used. The portion or patch of material having low friction may exhibit a lower coefficient of friction than the other portions of the sock. For example, cotton, or other cellulose containing fabrics may typically exhibit relatively higher coefficients of friction. In an embodiment, the other portions 14 of the sock 10 include greater cellulose (e.g., cotton, or other cellulose containing fabric materials) content than portions 12, 16 (which may contain lower, or even 0% cotton or other cellulose fabrics).

Both the rear low friction portion 12 above the heel and the front low friction portion 16 corresponding to the tongue location may have a width of e.g., from 1-3 inches (e.g., about 2 inches). Such portions may have a length that is greater than the width (e.g., so as to be elongate). For example, the length of such locations may be from 2-5 inches, or from 3-4 inches. In an embodiment, the low friction portion 12 above the heel may have a length of about 4 inches, and the front low friction portion 16 may have a length of about 3 inches.

In an embodiment, the sock 10 is not simply formed entirely from such a low friction material (e.g., nylon or polyester), as such materials may not provide other desired characteristics (e.g., ability to wick away moisture, breathability, insulation, etc.). Thus, in an embodiment, only limited portions of the sock (e.g., the two portions 12, 16 noted herein) are formed from the low friction fabric material. The remainder 14 of the sock 10 may be formed from more conventional sock materials (which exhibit greater coefficients of friction), such as one or more of wool, cotton, a cotton blend, bamboo fibers, rayon, lyocell, modal, viscose, spandex, etc.

As shown in FIG. 1, in an embodiment, such a sock 10 may be formed by providing an entire sock formed of the relatively higher friction materials 14, and then attaching patches 12 and 16, formed from a lower friction material, over the heel portions and tongue portions as shown, respectively. Such patches may simply be overlaid over a standard wool or other sock. Attachment to the underlying sock portions 14 may be by any suitable means, such as stitching, or use of an adhesive (e.g., hot iron adhesive), combinations thereof, or other attachment mechanisms that will be apparent to those of skill in the art. In an embodiment, such portions may simply be woven into the adjacent portions of the sock body.

The patches 12, 16 may thus be adhered or otherwise attached to the exterior surfaces of the sock, allowing the entire socked portion of the foot of a user to contact the higher friction material 14 (but such material 14 may have better moisture wicking, better insulative characteristics, etc. as compared to the material of patches 12, 16). In another embodiment, wherein the portions 12 and 16 are woven into the wool or other material of the sock body, with exposure on both an inside and outside surface of the sock, so as to contact a user's foot or leg inserted into the sock during use.

An embodiment such as that shown in FIGS. 13-16 may further include a hygroscopic material, e.g., which makes contact with the user's foot or leg inserted in the sock during use. Such hygroscopic materials may provide a significant heating effect to warm the user's feet and legs, when such materials become moistened or damp, as can occur when skiing, or pursuing other outdoor activities, particularly in a winter climate.

A method for manufacturing such a sock may include providing a sock body formed from a given sock material (e.g., wool, cotton blend, or the like as noted herein), selected to provide desired characteristics relative to moisture wicking, and insulation, said material having a coefficient of friction. Patch portions (e.g., corresponding to 12 and 16, as shown in FIG. 1) are then attached over an exterior of the sock body to provide decreased friction to particular exterior regions of the sock. As noted, the patch portions are formed from a different material (e.g., low coefficient of friction nylon or polyester, for example) as compared to the underlying sock body. The patch portions 12, 16 include a decreased friction patch portion 12 attached over a heel portion and extending to a location directly above the heel portion of the sock body and a decreased friction patch portion 16 attached over a front portion of the sock body, corresponding to a location of a tongue of a boot or shoe when the sock 10 is worn over a user's foot, inserted into such boot or shoe.

The patch portions can be stitched to the sock body, woven into the sock body, attached to the sock body with an adhesive, or both. In an embodiment the patch portions are attached to the sock body with a hot iron activated adhesive (e.g., a hot iron is used to attach the patch(es) to the sock. Such hot iron activated adhesives will be familiar to those of skill in the art, as they are often employed in other fields of fabric patching (e.g., when patching a hole).

In another embodiment, the present sock may be formed where the patch portions are integrated directly into the sock body, e.g., where such portions are not only present on the exposed exterior face of the sock, but are also on the inside of the sock, so as to contact the heel and tongue portions of the user's foot that is inserted into the sock. Nevertheless, in an embodiment, attachment may be as described above, where the patch portions 12, 16 are only exposed on the exterior surface of the sock, so that the full interior surface of the sock does not include such low friction materials (e.g., only other material 14, providing better moisture wicking, insulation, etc.).

FIGS. 13-16 show additional exemplary socks 10R and 10L, each including a sock body including portions formed from different materials to provide decreased friction in particular regions of the sock. A decreased friction heel portion 12 is provided directly above a heel portion of the sock, while a decreased friction tongue portion 16 is provided on a front portion of the sock, corresponding to the location of a tongue of a boot or shoe when the sock is worn over a user's foot. As shown in FIGS. 15A-16B and other Figures, tongue portion 16 may begin near or just above the inflection point along the front face of the sock, and extend upward therefrom, e.g., a few inches. As is apparent from FIG. 13-16, the socks may not be identical and interchangeable, but have distinct "right" and "left" socks 10R and 10L, that differ in the positioning or orientation of patch portions 12 and 16. For example, as shown, the reduced friction patches are not symmetrical relative to the fold line F of the sock, as shown. These differences may be particularly apparent in FIGS. 15A-16B, e.g., by comparing FIG. 15A with FIG. 15B, and comparing FIG. 16A with FIG. 16B. FIGS. 15A and 15B show opposite faces of the left sock, folded along the fold line F. FIGS. 16A-16B show opposite faces of the right sock, folded along the fold line F. In particular, the "tongue" patch 16 is positioned or oriented so that more of the surface area of patch 16 is oriented towards the outside (i.e., lateral direction) of the user's leg when worn, as compared to the inside (medial direction) of the user's leg. In other words, the patch is not simply centered to the front, relative to the wearer, or relative to the fold line F, but is offset, towards the outside or lateral portion of the user's leg (i.e., to the user's lateral left on the left leg and to the lateral right on the right leg). Stated another way, there is more of the patch 16 total surface positioned on the outside lateral surface of the leg—and less patch surface area positioned on the inside medial surface of the leg, as is apparent from the folded socks see in FIGS. 15A-16B.

The heel patch 12 is opposite—with more of the patch 12 positioned or oriented towards the inside medial portion of the leg, with less surface area of the patch 12 positioned towards the outside lateral portion of the leg. The difference in surface area as separated across the fold line F may be such that greater than 50%, at least 55%, at least 60%, or at least 65% of the patch surface area is positioned on the dominant side relative to the fold line F (e.g., the lateral portion dominates on patch 16, while the medial portion dominates on patch 12). Similarly, the difference in surface area as separated across the fold line F may be such that less than 50%, less than 45%, less than 40%, or less than 35% of the patch surface area is positioned on the non-dominant side relative to the fold line F. Exemplary ranges for the dominant side may be from about 55% to about 80%, or from about 60% to about 70%. Exemplary ranges for the non-dominant side may be from about 20% to about 45%, or from about 30% to about 40%.

Because of these differences, there are "left" and "right" socks, which are not simply identical and interchangeable. Such particular positioning of the patches relative to the fold line or the front centerline of the wearer is actually beneficial in use, facilitating easier insertion of the socked foot and leg into a boot, as compared to if the positioning of the patches were centered, and there were no "left" or "right" versions of the socks.

Socks 10 also show the inclusion of a hygroscopic material (e.g., woven into the wool or other sock material). Such patches 18 are shown provided within the bottom of the foot portion of the sock, as well as extending up the back portion of the leg. Such a hygroscopic thread material can simply be woven into the sock material (as can the reduced friction patches 12, 16). The hygroscopic material advantageously provides a warming effect (e.g., of up to 9° C. warmer) to the bottom of the feet and the back of the legs, where positioned, when the material becomes moistened or damp. For example, far infrared emission ceramic particles may be provided in such threads or other fibers, gently raising the body temperature by increasing reflection of body heat, to improve blood circulation during outdoor activities. Such hygroscopic heat is generated by the loss of kinetic energy of water molecules, which are absorbed at the surface of the hygroscopic textile material, where such a warming reaction occurs (e.g., see ISO 18782-2015 Textiles—Determination of Hygroscopic Heat Generation).

For example, the hygroscopic threads or other hygroscopic material can be woven into a wool or other material of the sock body, such hygroscopic threads or other hygroscopic material being positioned along a bottom portion of the foot of the sock, to warm a bottom portion of a user's feet during use. As shown, the hygroscopic threads or other hygroscopic material can also be positioned along an upper rear portion of the sock, to warm a rear portion of a user's legs covered by the sock during use. Where woven into the sock body material, both the sock body material and the hygroscopic material may be present on both the exterior and interior surfaces of the sock. Such is also true, for the reduced friction patch portions 12, 16, which may similarly be woven into the wool or other material of the sock, so as to be present on both the interior and exterior surfaces of the sock.

The hygroscopic portions (e.g., particularly those portions shown woven into the back of the leg) could also be positioned so that the surface area of such portion dominates towards either a lateral or medial orientation, similar to as described relative to patch portions 12 and 16. In another embodiment, the hygroscopic portions may simply be centered relative to the fold line—providing approximately 50% surface area on both sides, relative to the fold line F.

In addition, unless otherwise indicated, numbers expressing quantities, constituents, distances, or other measurements used in the specification and claims are to be understood as optionally being modified by the term "about" or its synonyms. When the terms "about," "approximately," "substantially," or the like are used in conjunction with a stated amount, value, or condition, it may be taken to mean an amount, value or condition that deviates by less than 20%, less than 10%, less than 5%, less than 1%, less than 0.1%, or less than 0.01% of the stated amount, value, or condition.

In reference to various standardized tests (e.g., ISO, ASTM or other tests), it will be understood that reference to any such standard refers to the latest update (if any) of such standard, unless otherwise indicated. Any such referenced standards are incorporated herein by reference, in their entirety.

All publications, patents and patent applications cited herein, whether supra or infra, are hereby incorporated by reference in their entirety to the same extent as if each individual publication, patent or patent application was specifically and individually indicated to be incorporated by reference.

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise. Thus, for example, reference to a "surfactant" includes one, two or more surfactants.

Unless otherwise stated, all percentages, ratios, parts, and amounts used and described herein are by weight.

Some ranges may be disclosed herein. Additional ranges may be defined between any values disclosed herein as being exemplary of a particular parameter. All such ranges are contemplated and within the scope of the present disclosure.

As used herein, the term "between" is inclusive of any endpoints noted relative to a described range.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

The present invention can be embodied in other specific forms without departing from its spirit or essential characteristics. Thus, the described implementations are to be considered in all respects only as illustrative and not restrictive. The scope of the invention is, therefore, indicated by the appended claims rather than by the foregoing description. All changes that come within the meaning and range of equivalency of the claims are to be embraced within their scope.

The invention claimed is:

1. A pair of socks comprising:

a left sock comprising:

a left sock body including portions formed from different materials to provide decreased friction in particular regions of the left sock;

wherein a first decreased friction patch portion of the left sock body is provided directly above a heel portion of the left sock; and wherein a second decreased friction patch portion of the left sock body is provided on a front portion of the left sock, corresponding to a location of a tongue of a boot or shoe when the left sock is worn over a user's left foot, inserted into such boot or shoe; and a right sock comprising:

a right sock body including portions formed from different materials to provide decreased friction in particular regions of the right sock;

wherein a first decreased friction patch portion of the right sock body is provided directly above a heel portion of the right sock; and wherein a second decreased friction patch portion of the right sock body is provided on a front portion of the right sock, corresponding to a location of a tongue of a boot or shoe when the right sock is worn over a user's right foot, inserted into such boot or shoe;

wherein the left and right socks are not identical to one another, but differ in how the first patch portion and the second patch portion of the left and right socks are positioned or oriented, relative to a fold line of the left and right socks, wherein:

on both the left and right socks, a greater surface area of the first patch portion is positioned or oriented towards an interior of a leg of the respective sock, with a lesser surface area of the first patch portion positioned or oriented towards an exterior of the leg; and on both the left and right socks, a greater surface area of the second patch portion is positioned or oriented towards an exterior of the leg, with a lesser surface area of the second patch portion positioned or oriented towards an interior of the leg.

2. The pair of socks as recited in claim 1, wherein the first patch portion of at least one of the left sock or the right sock has a width of about 2 inches.

3. The pair of socks as recited in claim 1, wherein the second patch portion of at least one of the left sock or the right sock has a width of about 2 inches.

4. The pair of socks as recited in claim 1, wherein the first patch portion of at least one of the left sock or the right sock has a length of about 4 inches.

5. The pair of socks as recited in claim 1, wherein the second patch portion of at least one of the left sock or the right sock has a length of about 3 inches.

6. The pair of socks as recited in claim 1, wherein a remainder of the left sock body which consists of the left sock body other than the first patch portion and the second patch portion of the left sock body is formed from one or more of wool, cotton, a cotton blend, bamboo fibers, rayon, lyocell, modal, viscose, or spandex, such material exhibiting greater coefficient of friction than the first patch portion and the second patch portion of the left sock body.

7. The pair of socks as recited in claim 6, wherein a remainder of the right sock body which consists of the right sock body other than the first patch portion and the second patch portion of the right sock body is formed from one or more of wool, cotton, a cotton blend, bamboo fibers, rayon, lyocell, modal, viscose, or spandex, such material exhibiting greater coefficient of friction than the first patch portion and the second patch portion of the right sock body.

8. The pair of socks as recited in claim 1, wherein the first patch portion and the second patch portion of the left sock are formed from one or more of a nylon or polyester material having a lower coefficient of friction than a remainder of the left sock body, wherein the remainder of the left sock body is formed from one or more of wool, cotton, a cotton blend, bamboo fibers, rayon, lyocell, modal, viscose, or spandex, wherein the material of the remainder of the left sock body exhibits greater coefficient of friction than the first patch portion and the second patch portion of the left sock.

9. The pair of socks as recited in claim 8, wherein the first patch portion and the second patch portions of the right sock are formed from one or more of a nylon or polyester material having a lower coefficient of friction than a remainder of the right sock body, wherein the remainder of the right sock body is formed from one or more of wool, cotton, a cotton blend, bamboo fibers, rayon, lyocell, modal, viscose, or spandex, wherein the remainder of the material of the right sock body exhibits greater coefficient of friction than the first patch portion and the second patch portion of the right sock.

10. The pair of socks as recited in claim 1, wherein the first patch portion and the second patch portion of the left sock are woven into a wool material of the left sock body, such that the decreased friction material of the first and second patch portions of the left sock extend onto both an inside surface and an outside surface of the left sock, so as to contact a user's foot inserted into the left sock during use.

11. The pair of socks as recited in claim 10, wherein the first patch portion and the second patch portion of the right sock are woven into a wool material of the right sock body, such that the decreased friction material of the first and second patch portions of the right sock extend onto both an inside surface and an outside surface of the right sock, so as to contact a user's foot inserted into the right sock during use.

12. The pair of socks as recited in claim 1, wherein at least one of the left sock or the right sock further includes hygroscopic threads or fibers that include far infrared emission ceramic particles, wherein said far infrared emission ceramic particles are configured to provide a heating effect when such said hygroscopic threads or fibers are moistened or damp.

13. The pair of socks as recited in claim 12, wherein the hygroscopic threads or fibers are woven into a material of at least one of the left or right sock body, said hygroscopic threads or fibers being positioned along a bottom portion of a foot of at least one of the left or right sock, to warm a bottom portion of a user's feet during use.

14. The pair of socks recited in claim 12, wherein the hygroscopic threads or fibers are woven into a material of at least one of the left or right sock body, said hygroscopic threads or fibers being positioned along an upper rear portion of at least one of the left or right sock, to warm a rear portion of a user's legs covered by at least one of the left or right sock during use.

15. The pair of socks as recited in claim 1:

wherein the first patch portion of the left sock body is provided to include both a heel portion and a portion directly above the heel portion of the left sock; and wherein the first and second patch portions of the left sock are formed from one or more of a nylon or polyester material having a lower coefficient of friction than a remainder of the left sock body, wherein the remainder of the left sock body is formed from one or more of wool, cotton, a cotton blend, bamboo fibers, rayon, lyocell, modal, viscose, or spandex, wherein the material of the remainder of the left sock body exhibits greater coefficient of friction than the first and second patch portions of the left sock.

16. The pair of socks as recited in claim 15:

wherein the first patch portion of the right sock body is provided to include both a heel portion and a portion directly above the heel portion of the right sock; and wherein the first and second patch portions of the right sock are formed from one or more of a nylon or polyester material having a lower coefficient of friction than a remainder of the right sock body, wherein the remainder of the right sock body is formed from one or more of wool, cotton, a cotton blend, bamboo fibers, rayon, lyocell, modal, viscose, or spandex, wherein the material of the right sock body exhibits greater coefficient of friction than the first and second patch portions of the right sock.

17. The pair of socks as recited in claim 1, wherein a remainder of the right sock body which consists of the right sock body other than the first patch portion and the second patch portion of the right sock body is formed from one or more of wool, cotton, a cotton blend, bamboo fibers, rayon, lyocell, modal, viscose, or spandex, such material exhibiting greater coefficient of friction than the first patch portion and the second patch portion of the right sock body.

18. The pair of socks as recited in claim 1, wherein the first patch portion and the second patch portion of the right sock are formed from one or more of a nylon or polyester material having a lower coefficient of friction than a remainder of the right sock body, wherein the remainder of the right sock body is formed from one or more of wool, cotton, a cotton blend, bamboo fibers, rayon, lyocell, modal, viscose, or spandex, wherein the remainder of the material of the right sock body exhibits greater coefficient of friction than the first patch portion and the second patch portion of the right sock.

19. The pair of socks as recited in claim 1, wherein the first patch portion and the second patch portion of the right sock are woven into a wool material of the right sock body, such that the decreased friction material of the first and second patch portions of the right sock extend onto both an inside surface and an outside surface of the right sock, so as to contact a user's foot inserted into the right sock during use.

20. The pair of socks as recited in claim 1:

wherein the first patch portion of the right sock body is provided to include both a heel portion and a portion directly above the heel portion of the right sock; and wherein the first and second patch portions of the right sock are formed from one or more of a nylon or polyester material having a lower coefficient of friction than a remainder of the right sock body, wherein the remainder of the right sock body is formed from one or more of wool, cotton, a cotton blend, bamboo fibers, rayon, lyocell, modal, viscose, or spandex, wherein the material of the right sock body exhibits greater coefficient of friction than the first and second patch portions of the right sock.

* * * * *